US012398637B2

(12) United States Patent
Guo et al.

(10) Patent No.: US 12,398,637 B2
(45) Date of Patent: Aug. 26, 2025

(54) IDENTIFYING BIT WEAR AND JUSTIFYING BIT TRIP

(71) Applicant: Halliburton Energy Services, Inc., Houston, TX (US)

(72) Inventors: Yonggui Guo, Houston, TX (US); Shilin Chen, Conroe, TX (US); Dale E. Jamison, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/514,223

(22) Filed: Nov. 20, 2023

(65) Prior Publication Data

US 2025/0163794 A1 May 22, 2025

(51) Int. Cl.
*E21B 44/00* (2006.01)
*E21B 12/02* (2006.01)

(52) U.S. Cl.
CPC ..... *E21B 44/00* (2013.01); *E21B 12/02* (2013.01)

(58) Field of Classification Search
CPC ..... E21B 44/00; E21B 12/02
See application file for complete search history.

(56) References Cited

U.S. PATENT DOCUMENTS 6,408,953 B1 * 6/2002 Goldman ..... E21B 49/003 702/9
8,672,055 B2 * 3/2014 Boone ..... E21B 7/04 175/45
9,022,140 B2 * 5/2015 Marx ..... G06N 7/01 175/50
9,249,654 B2 2/2016 Strachan et al.
11,230,914 B2 * 1/2022 Ringer ..... E21B 47/00
11,492,892 B2 * 11/2022 Parak ..... E21B 47/12
11,697,969 B2 * 7/2023 Potash ..... G06T 7/001 700/175
12,050,297 B2 * 7/2024 AlSinan ..... E21B 49/02
(Continued)

FOREIGN PATENT DOCUMENTS

EP 0163426 B1 * 7/1988
WO WO-2008070829 A2 * 6/2008 ..... E21B 44/00
WO WO-2020167334 A1 * 8/2020 ..... E21B 44/00

OTHER PUBLICATIONS

Al-Rashidi, et al., "Designing Neural Networks for the Prediction of the Drilling Parameters for Kuwait Oil and Gas Fields", College of Engineering and Mineral Resources At West Virginia University, Graduate Theses, Dissertations, and Problem Reports, 2000, 87 pages.

(Continued)

*Primary Examiner* — Daniel P Stephenson
(74) *Attorney, Agent, or Firm* — DeLizio, Peacock, Lewin & Guerra LLP

(57) ABSTRACT

A method performed while drilling a wellbore in a subsurface formation with a drill bit. The method comprises obtaining sonic logs of the subsurface formation proximate the drill bit. The method comprises determining mechanical specific energy based on drilling parameters. The method comprises comparing respective trends of the sonic logs and the mechanical specific energy of the drill bit to identify a cause for a change in drilling performance of the drill bit. The method comprises performing a drilling operation based on the cause for the change in the drilling performance.

20 Claims, 6 Drawing Sheets

(56) References Cited

U.S. PATENT DOCUMENTS

| | | | | |
|---|---|---|---|---|
| 2014/0025301 | A1* | 1/2014 | Storm, Jr. | E21B 49/005 702/6 |
| 2015/0090498 | A1 | 4/2015 | Hareland | |
| 2016/0305231 | A1* | 10/2016 | Majidi | E21B 49/003 |
| 2018/0023382 | A1 | 1/2018 | Ringer et al. | |
| 2018/0038226 | A1* | 2/2018 | Logan | E21B 49/00 |
| 2018/0334897 | A1 | 11/2018 | Samuel et al. | |
| 2020/0362686 | A1* | 11/2020 | Puwanto | E21B 21/10 |
| 2022/0316328 | A1 | 10/2022 | Srivastava et al. | |
| 2024/0328308 | A1* | 10/2024 | Lee | E21B 47/12 |
| 2025/0163794 | A1* | 5/2025 | Guo | E21B 44/00 |

OTHER PUBLICATIONS

Bilgesu, et al., "A New Approach for the Prediction of Rate of Penetration (ROP) Values", SPE Eastern Regional Meeting, Lexington, Kentucky, Oct. 1997, 5 pages.

Bourgoyne, Jr., et al., "A Multiple Regression Approach to Optimal Drilling and Abnormal Pressure Detection", Society of Petroleum Engineers Journal 14 (04) Paper No. SPE-4238-PA, Aug. 1974, pp. 371-384.

Celada, et al., "The Use of the Specific Drilling Energy for Rock Mass Characterisation and TBM Driving During Tunnel Construction", ITA-AITES World Tunnel Congress 2009, Budapest, Hungary, 2009, 12 pages.

Chang, et al., "Empirical Relations Between Rock Strength and Physical Properties in Sedimentary Rocks", Journal of Petroleum Science and Engineering 51, Jan. 6, 2006, pp. 223-237.

Hareland, "Use of Drilling Parameters To Predict In-Situ Stress Bounds", SPE/IADC Drilling Conference held in Amsterdam Feb. 23-25, 1993, 1993, 15 pages.

Moran, et al., "Sophisticated ROP Prediction Technologies Based on Neural Network Delivers Accurate Drill Time Results", IADC/SPE Asia Pacific Drilling Technology Conference and Exhibition, 2010, 9 pages.

Pinto, et al., "Mechanical Specific Energy for Drilling Optimization in Deepwater Brazilian Salt Environments", Society of Petroleum Engineers, 2016, 18 pages.

Richard, et al., "The Scratch Test as a Means to Measure Strength of Sedimentary Rocks", SPE/ISRM Rock Mechanics in Petroleum Engineering, Trondheim, Norway, Jul. 1998, 8 pages.

Teale, "The Concept of Specific Energy in Rock Drilling", International Journal of Rock Mechanics and Mining Sciences & Geomechanics Abstracts vol. 2, Issue 1, Mar. 1965, pp. 57-73.

Warren, "Drilling Model for Soft-Formation Bits", Society of Petroleum Engineers of AIME, Jun. 1981, 8 pages.

"PCT Application No. PCT/US24/39070 International Search Report and Written Opinion", Oct. 30, 2024, 9 pages.

* cited by examiner

IDENTIFYING BIT WEAR AND JUSTIFYING BIT TRIP

FIELD

The disclosure generally relates to drilling of wellbores and more particularly, to identifying bit wear in a drill bit while drilling a wellbore.

BACKGROUND

A drill bit may be utilized to physically cut the rock to form a wellbore in a subsurface formation. As a drill bit drills through the subsurface formation, the cutting elements can experience wear. As a cutting element wears, it becomes less effective and has a higher likelihood of failure. Cutting element wear may have a significant effect on the rate of penetration (ROP). The ROP is important for reducing costs during drilling operations as an increase in the ROP can reduce operating time. ROP can be impacted by several variables including the drill bit type, geological formation characteristics, drilling fluid properties, operating conditions, drill bit hydraulics, and cutting element wear and damage. When a drill bit is worn, the drill bit must be pulled (i.e., tripped) out of the wellbore and replaced to improve drilling efficiency and reduce drilling cost.

BRIEF DESCRIPTION OF THE DRAWINGS

Implementations of the disclosure may be better understood by referencing the accompanying drawings.

DESCRIPTION

Figure 1:
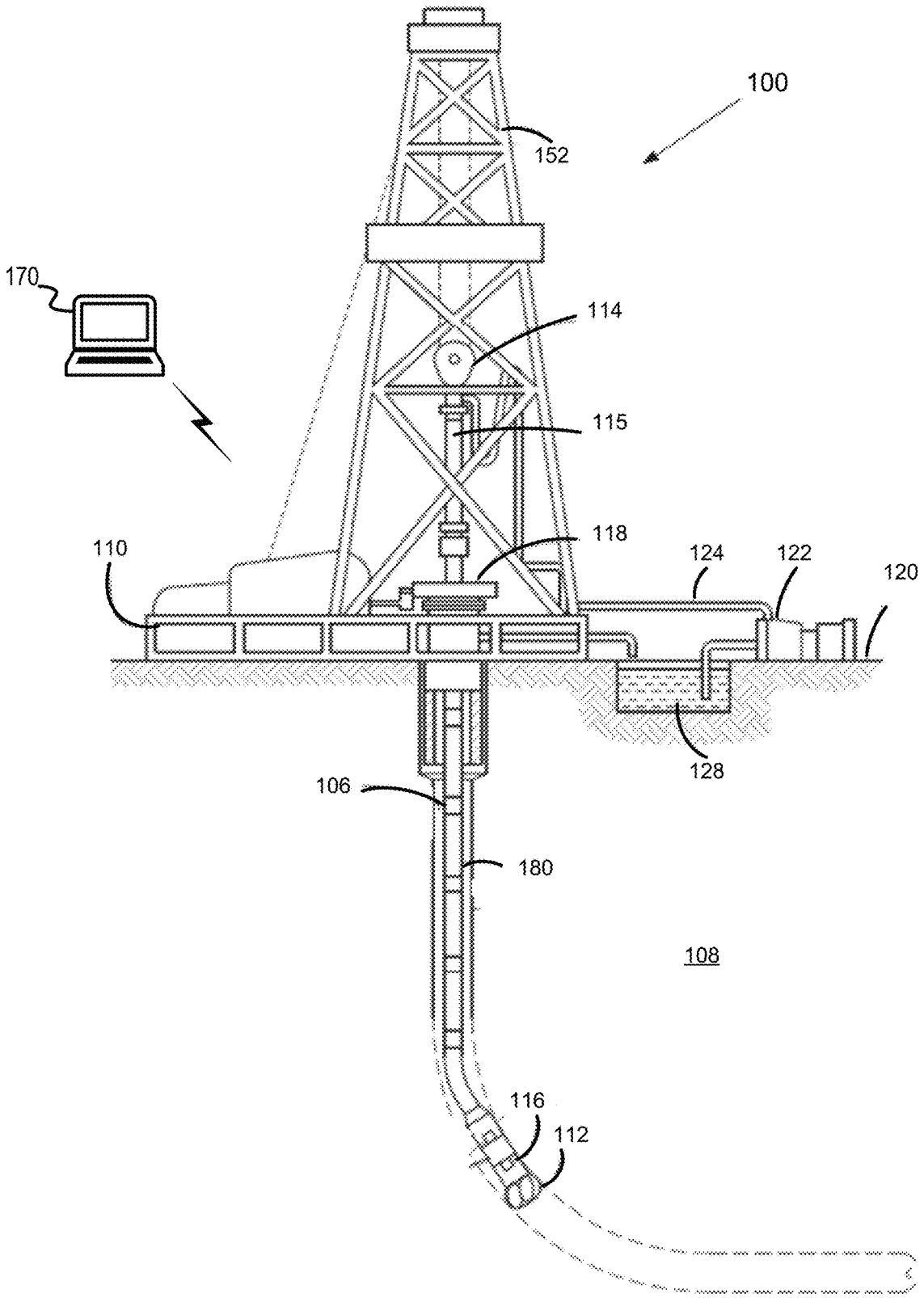
FIG. 1 is a schematic depicting an example well system, according to some implementations.

The description that follows includes example systems, methods, techniques, and program flows that embody aspects of the disclosure. However, it is understood that this disclosure may be practiced without these specific details. For instance, this disclosure refers to PDC drill bits in illustrative examples. Aspects of this disclosure can also be applied to any other types of drill bits or drilling tools. In other instances, well-known instruction instances, protocols, structures, and techniques have not been shown in detail in order not to obfuscate the description.

Example implementations relate to identifying bit wear and justifying a bit trip when drilling a wellbore in a subsurface formation. During the drilling process, it may be critical to know the bit wear and/or damage status of a drill bit in order to determine when to pull out (i.e., trip out) the drill bit from the wellbore to be replaced. Physically, to cut a rock, the drilling system (such as the drill pipe, bottom hole assembly (BHA), traveling block, etc.) may need to apply sufficient energy to overcome the strength of the rock under any given confining pressure. Stronger rock may require more mechanical work to remove the same volume of rock by the same bit. The mechanical work required to destroy a unit volume of rock may be quantified with mechanical specific energy (MSE). In some implementations, the MSE may be expressed in terms of drilling parameters measured at the surface or at the drill bit such as weight-on-bit (WOB), torque-on-bit (TOB), drill bit rotations per minute (RPM), rate of penetration (ROP), drill bit diameter, etc. It has been demonstrated that MSE under atmospheric pressure may be approximately equal to the uniaxial compressive strength (UCS) of the rock. Additionally, drilling parameters may also be utilized to build correlations between MSE and UCS for various rock types.

In some implementations, UCS may correlate with sonic logs (delta T compressional (DTC), i.e., compressional wave velocity) due to the speed of compressional waves in rock being affected by the rock porosity. The speed of compressional waves may decrease with increasing rock porosity. Additionally, the rock strength may also be influenced by the rock porosity, where the rock strength may decrease with increasing rock porosity. Hence, the speed of the compressional waves may increase with increasing rock strength. Due to the strong correlation between compressional wave velocity and UCS, conventional approaches may apply compressional wave velocity to derive UCS based on empirical equations derived from rock strength lab testing.

Since both MSE and compressional wave velocity may be correlated with UCS, they may be expected to show approximately similar trend variations with depth if the drill bit is new and drilling parameters are not affected by other factors besides rock strength (such as tight hole condition). If MSE shows an increasing trend over a depth interval, but the compressional wave velocity trend is decreasing and/or does not change over the same depth interval, then the increase in MSE may be attributed to bit wear. Thus, the comparison of the respective trends of MSE and sonic logs may provide a feasible way to evaluate the condition of the drill bit while drilling a wellbore.

In some implementations, sonic logs may be obtained of the subsurface formation for the wellbore being drilled in the subsurface formation. The sonic logs may include sonic measurements obtained from sensors proximate the drill bit while drilling the wellbore, inferred sonic measurements from offset well logs (i.e., predrill sonic logs), derived sonic measurements from seismic data, etc. In some implementations, models, such as machine learning models, may be applied to generate the sonic log based on seismic measurements or sonic logs from offset wells. In some implementations, the MSE of the drill bit may be determined while drilling the wellbore based on the drilling parameters that are measured at the drill bit/or at the surface. The drilling parameters measured at the drill bit may be the preferred data to determine the MSE. The respective trends of the sonic logs and MSE may be continuously compared while drilling the wellbore to identify a cause for a change in drilling performance. For example, the drilling performance may be measured via ROP, and a significant decrease in ROP may be indicative of a decrease in drilling performance. The cause for change in the decrease in ROP may be bit wear and/or increased rock strength. In some implementations, the respective trends of sonic logs and MSE over a depth interval may indicate whether the decrease in ROP is due to bit wear or an increase in rock strength.

In some implementations, a drilling operation may be performed based on the cause for the change in the drilling performance. Examples of drilling operations include tripping out the drill bit to be replaced, adjusting a drilling parameter, etc. For instance, the respective trends of the sonic logs and the MSE indicate the drill bit is worn and/or damaged. Accordingly, the drill string, with the drill bit, may be tripped out of the wellbore to be replaced with a new drill bit. Alternatively, if the respective trends indicate an increase in rock strength, WOB and/or RPM may be increased to continue drilling through the rock and increase ROP.

Example Well System

FIG. 1 is a schematic depicting an example well system, according to some implementations. In particular, FIG. 1 is a schematic diagram of a well system 100 that includes a drill string 106 having a drill bit 112 disposed in a wellbore 180 for drilling the wellbore 180 in the subsurface formation 108. While depicted for a land-based well system, example embodiments can be used in subsea operations that employ floating or sea-based platforms and rigs. The drill bit 112 is an example downhole cutting structure for which simulation of the downhole cutting structure's drilling performance as described herein can be performed.

The well system 100 may further include a drilling platform 110 that supports a derrick 152 having a traveling block 114 for raising and lowering the drill string 106. The drill string 106 may include, but is not limited to, drill pipe, drill collars, and downhole tools 116. The downhole tools 116 may comprise any of a number of different types of tools including measurement while drilling (MWD) tools, logging while drilling (LWD) tools, mud motors, and others. A kelly 115 may support the drill string 106 as it may be lowered through a rotary table 118. While FIG. 1 is described relative to a drill bit, aspects of the disclosure may be applied to any downhole cutting structure or multiple downhole cutting structures. For instance, the drill bit 112 may include roller cone bits, polycrystalline diamond compact (PDC) bits, natural diamond bits, any hole openers, reamers, coring bits, and the like. As the drill bit 112 rotates, it may crush or cut rock to create and extend a wellbore 180 that penetrates various subterranean formations. The drill bit 112 may be rotated by various methods including rotation by a downhole mud motor and/or via rotation of the drill string 106 from the surface 120 by the rotary table 118. A pump 122 may circulate drilling fluid through a feed pipe 124 to the kelly 116, downhole through interior of the drill string 106, through orifices in the drill bit 112, back to the surface 120 via an annulus surrounding the drill string 106, and into a retention pit 128. Parameters of drilling the wellbore 180 may be adjusted to increase, decrease, and/or maintain the rate of penetration (ROP) of the drill bit 112 through the subsurface formation 108. Drilling parameters may include parameters measured at the surface 120 including weight-on-bit (WOB), torque-on-bit (TOB), rotations-per-minute (RPM) of the drill string 106, etc. In some implementations, the downhole tools 116 may include sensors to obtain downhole drilling parameters as the drill bit 112 drills the subsurface formation 108. The drilling parameters obtained from the sensors may include downhole WOB, downhole TOB, downhole RPM, vibrations of the drill bit, etc. In some implementations, the drill bit 112 may become dull and lose efficiency, thus requiring more WOB and/or RPM to maintain a desired ROP. In some implementations, it may be inefficient to continue drilling operations with the worn drill bit 112 (i.e., a desired ROP may not be maintained), and the drill string 106 may need to be pulled out of the wellbore 180 (i.e., tripped out) to replace the drill bit 112.

Figure 6:
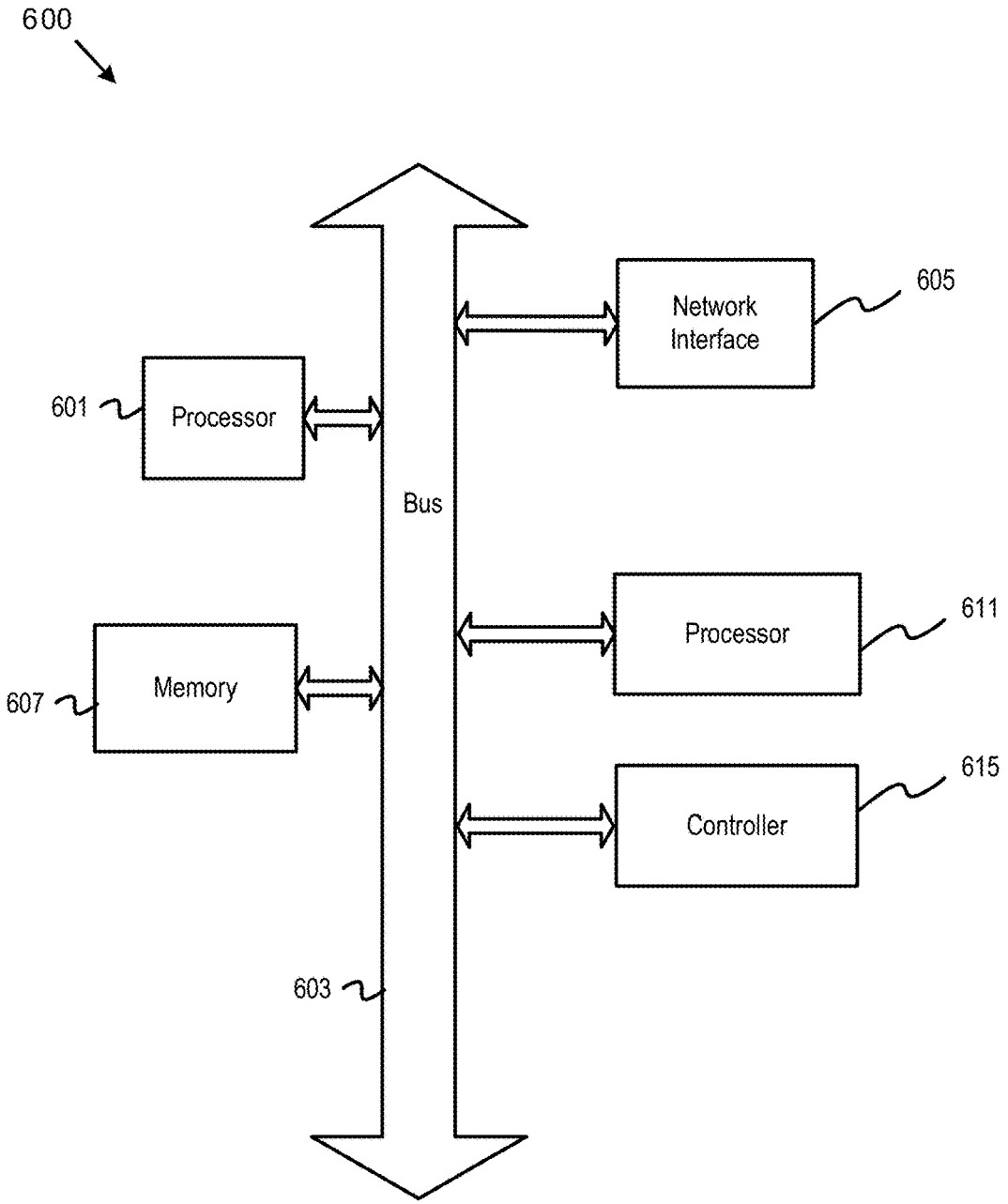
FIG. 6 is a block diagram depicting an example computer, according to some implementations.

The well system 100 includes a computer 170 that may be communicatively coupled to other parts of the well system 100. The computer 170 can be local or remote to the drilling platform 110. A processor of the computer 170 may perform simulations (as further described below). In some embodiments, the processor of the computer 170 may control drilling operations of the well system 100 or subsequent drilling operations of other wellbores. For instance, the processor of the computer 170 may compare the respective trends of sonic logs and MSE while drilling the wellbore 180 with the drill bit 112. When there is a change in drilling performance of the drill bit 112 (such as a decrease in ROP), the processor of the computer 170 may determine the cause for a change in the drilling performance such as bit wear and an increase in rock strength. In some implementations, the processor of the computer 170 may perform a drilling operation based on the cause for the change in the drilling performance. An example of the computer 170 is depicted in FIG. 6, which is further described below.

Example Drill Bit

Figure 2A:
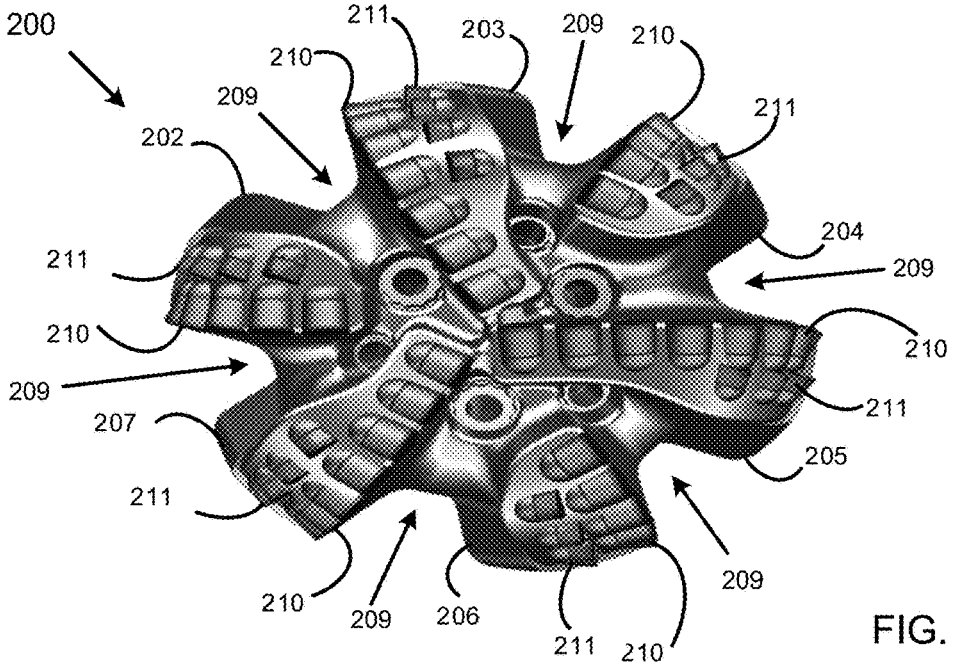
FIGS. 2A-2B are schematics depicting an example drill bit, according to some implementations.
Figure 2B:
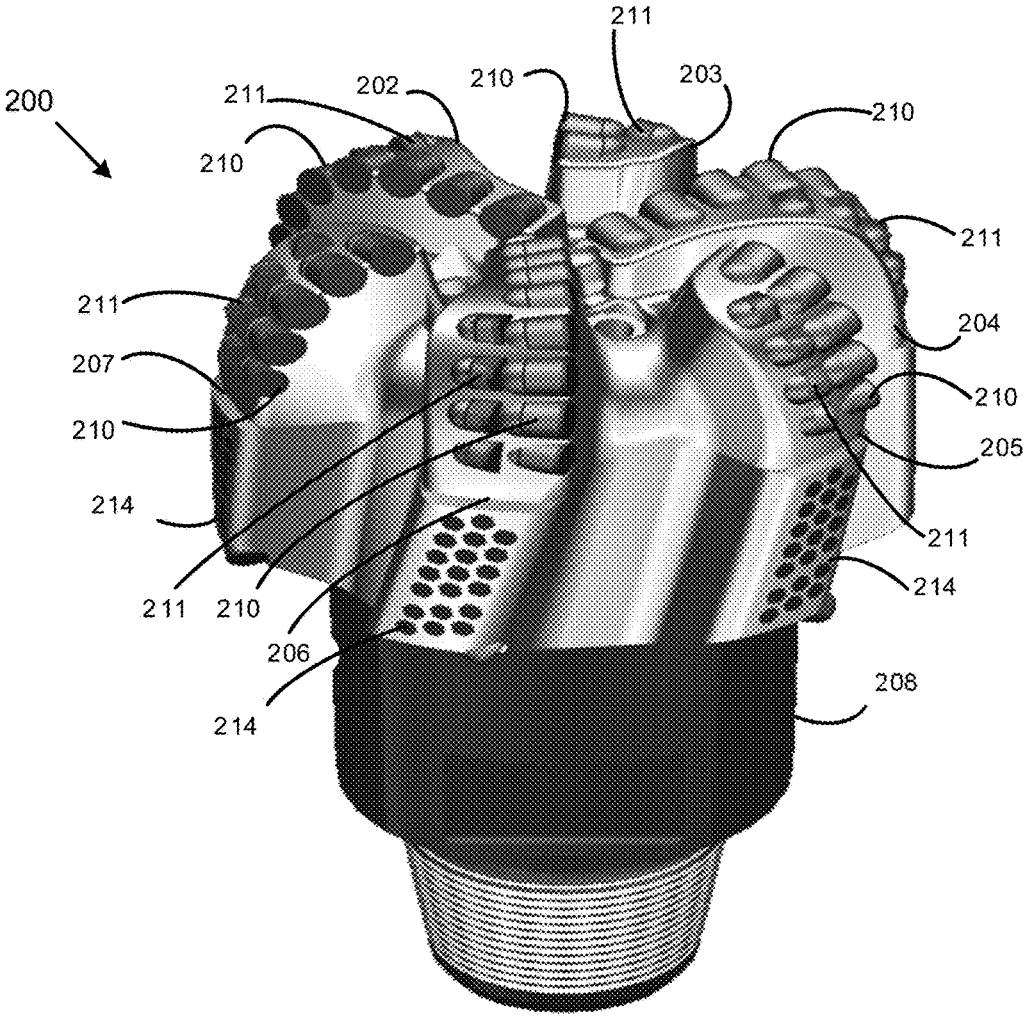

FIGS. 2A-2B are schematics depicting an example drill bit, according to some implementations. In particular, FIGS. 2A-2B depict an example drill bit 200. The drill bit 200 can be an example of the drill bit 112 of FIG. 1. As shown in this example, the drill bit 200 includes six blades 202-207, which can be integrally formed and extend from a bit body 208. The blades 202-207 are separated by flow channels 209 that may include nozzles (i.e., orifices) where drilling mud can be ejected through the drill bit 200 and into the wellbore. Primary cutters 210, backup cutters 211, and depth of cut controllers (DOCCs) may be mounted on the blades 202-207. During drilling, the face of the primary cutters 210 and backup cutters 211 can be in contact with and cut and/or shear the rock of the subsurface formation to create and extend a wellbore. In some instances, the face of the primary cutters 210 may be extended a greater distance from the blades 202-207 than the backup cutters 211 such that only the primary cutters 210 can be in contact with the rock of the subsurface formation. During drilling, the primary cutters 210 may become worn or broken such that one or more of the backup cutters 211 can then be in contact with the rock of the subsurface formation. Many factors including orientation, shape, type, and density of the cutters may vary depending on the design of the drill bit 200. Other drill bit characteristics including the number of blades, the shape of the blades, etc. may vary depending on the subsurface formation environment that the drill bit 200 may drill. Pads 214 may extend from the side of the blades 202-207. The pads 214 may help maintain the size of the wellbore to a full gauge diameter, particularly when cutters become dull and become under gauge.

Example Operations

Example operations for identifying bit wear while drilling a wellbore are now described in reference to FIGS. 4A-4B, FIGS. 5A-5B. This section describes operations associated with some implementations of the invention. In the discussion below, the flow diagrams may be described with reference to the example system presented above. In certain implementations, the operations are performed by executing instructions residing on machine-readable media (e.g., software), while in other implementations, the operations are performed by hardware and/or other logic (e.g., firmware). In some implementations, the operations are performed in series, while in other implementations, one or more of the operations can be performed in parallel. Moreover, some implementations perform less than all the operations shown in the flow diagrams.

Figure 3:
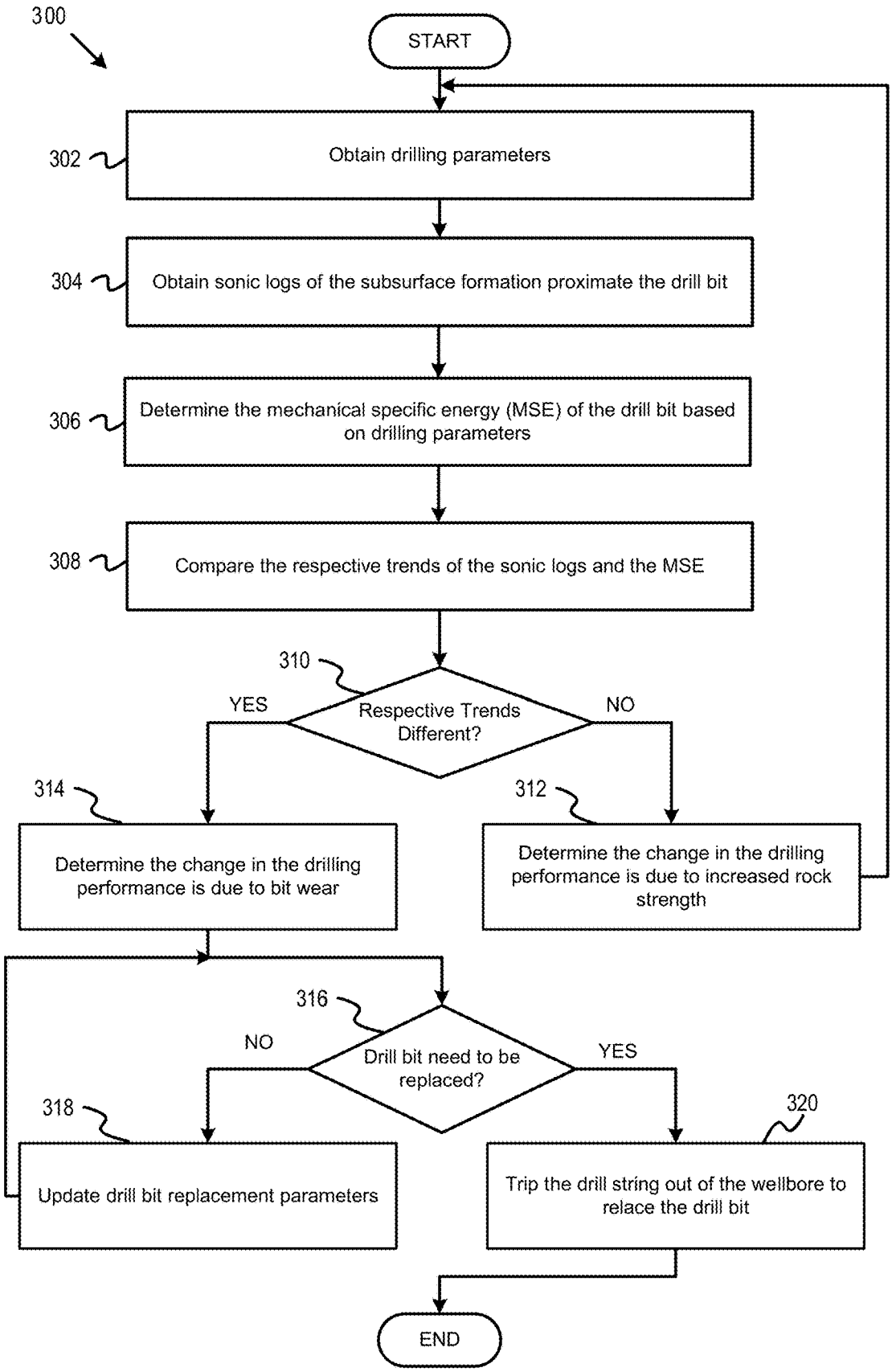
FIG. 3 is a flowchart depicting example operations to identify a cause for a change in drilling performance while drilling a wellbore with a drill bit, according to some implementations.

FIG. 3 is a flowchart depicting example operations to identify a cause for a change in drilling performance while drilling a wellbore with a drill bit, according to some implementations. In particular, FIG. 3 includes a flowchart 300 of operations to continuously compare the respective trends of sonic logs and MSE while drilling a wellbore with a drill bit. Operations of the flowchart 300 of FIG. 3 are described in reference to the computer 170 of FIG. 1. The computer 170 may perform any or all of the operations described with reference to FIG. 3. Operations of the flowchart 300 start at block 302.

At block 302, the processor of the computer 170 may obtain drilling parameters. The drilling parameters may include drilling parameters at the drill bit such as weight-on-bit (WOB), torque-on-bit (TOB), rotations per minute (RPM), etc. In some implementations, the downhole drilling parameters may be obtained by sensors on or near the drill bit. For example, the drill bit may include in-bit sensors to measure the downhole drilling parameters. Drilling parameters may include drilling parameters measured at the surface such as rate of penetration (ROP), WOB, TOB, etc.

In some implementations, the drilling parameters may indicate a change in the drilling performance. For example, a change in drilling performance of the drill bit may be associated with a change in ROP or any other suitable drilling parameters. A decrease in ROP over a depth interval may indicate a decrease in the drilling performance of the drill bit.

At block 304, the processor of the computer 170 may obtain sonic logs of the subsurface formation proximate the drill bit. The sonic logs may include compressional wave velocity measurements of the subsurface formation. In some implementations, the drilling assembly may include drilling tools (such as the downhole tools 116 of FIG. 1) configured to obtain sonic log measurements of the subsurface formation while the wellbore is being drilled with the drill bit. In some implementations, the sonic logs of the subsurface formation proximate the drill bit may be derived from pre-drill sonic logs and/or seismic data. Sonic logs from offset wells (i.e., wellbores drilled in the subsurface formation at a different location) and/or seismic data may be utilized to infer the sonic logs of the subsurface formation proximate the wellbore being drilled to generate the predrill sonic logs. In some implementations, the sonic logs may be a combination of the predrill logs and the sonic logs obtained from drilling tools while drilling the wellbore. For example, the drilling tools may be positioned on the drill string up hole (i.e., towards the drilling rig) from the drill bit while drilling the wellbore. Accordingly, the sonic log measurements obtained from the drilling tools and the predrill sonic logs may be utilized to estimate the sonic log measurement proximate the drill bit.

At block 306, the processor of the computer 170 may determine the mechanical specific energy (MSE) of the drill bit based on drilling parameters. The MSE may be the MSE at the drill bit and/or the MSE at surface. For example, the MSE at the drill bit, represented by $MSE_{downhole}$ (using Equation 1 below), may be defined as follows:

$$MSE_{downhole} = \frac{4 * WOB}{\pi * d^2} + \frac{408 * TOB * RPM}{d^2 * ROP} \quad (1)$$

where WOB is the WOB at the drill bit, TOB is the TOB at the drill bit, RPM is the RPM at the drill bit, ROP is the ROP measured at the surface, and d is the diameter of the drill bit.

In some implementations, when the downhole drilling parameters are not available, surface drilling parameters (such as WOB, TOB, RPM, etc.) may be utilized to derive the MSE. For example, the Equation 1 may utilize the surface drilling parameters rather than the drilling parameters at the drill bit to derive the surface MSE.

To ensure the variation of MSE may be mainly caused by bit condition and rock strength, other factors that could affect the MSE may need to be evaluated, such as tight hole conditions. For example, the MSE at the drill bit, represented by $MSE_{downhole}$ (using Equation 2 below), may be defined as follows:

$$MSE_{downhole} = MSE_{surface} - \Delta MSE \quad (2)$$

where $MSE_{downhole}$ is the MSE derived from drilling parameters measured at the drill bit, $MSE_{surface}$ is the MSE derived from drilling parameters measured at the surface, and ΔMSE is the variation of MSE unrelated to the changes of rock strength and bit condition (such as tight hole conditions).

In some implementations, the MSE may be utilized to predict the sonic log measurements at the bit. For example, if the drill bit is not damaged and ΔMSE is caused by rock strength, then ΔMSE may be directly correlated with the sonic log of the subsurface formation.

At block 308, the processor of the computer 170 may compare the respective trends of the sonic logs and the MSE. The sonic log trend and the MSE trend may be compared to determine if a change in the drilling performance (i.e., a decrease in the ROP) may be caused by bit wear or a change in rock strength. The sonic logs and MSE may be compared at specified time and/or depth intervals such as every 30 seconds, 1 minute, etc. and/or every foot drilled, every 30 feet drilled, etc., respectively. The sonic logs and MSE may be continuously compared when drilling the wellbore. In some implementations, the sonic logs and the MSE may be compared when there is a change in the drilling performance. For example, an ROP threshold may be set such that when ROP drops a specified amount (such as 10%) below the target ROP, average ROP over a distance, etc., the sonic logs and the MSE may be compared to determine what may have caused the change in drilling performance.

In some implementations, trends within the sonic logs and MSE may be identified. The trends may be identified when there is a change in the drilling performance. For example, the trend of the sonic log and the trend of the MSE may be identified when the ROP decreases below the ROP threshold. The respective trends may be across similar depth intervals such that the respective trends may be compared to determine the cause for the change in the drilling performance.

In some implementations, the sonic logs and MSE may be compared to historical data to confirm the correlation between the respective trends of the sonic logs and MSE and the change in the drilling performance. For example, offset logs may be utilized to model the sonic log measurements of the subsurface formation being drilled. The sonic logs obtained while drilling may be compared to the historical sonic logs to verify a change in trend.

At block 310, the process of the computer may determine if the respective trends of the sonic logs proximate the drill bit and MSE are different. The trends may be the respective trend of the sonic logs and MSE over an approximately similar depth interval. If the sonic log and MSE both show the same and/or similar increasing trends, then the decrease in ROP may be attributed to an increase in rock strength. Alternatively, if the sonic log and MSE show different trends, the decrease in ROP may be attributed to bit wear and/or damage.

To help illustrate, graphs of MSE and sonic logs to compare the respective trends are now described.

Figure 4B:
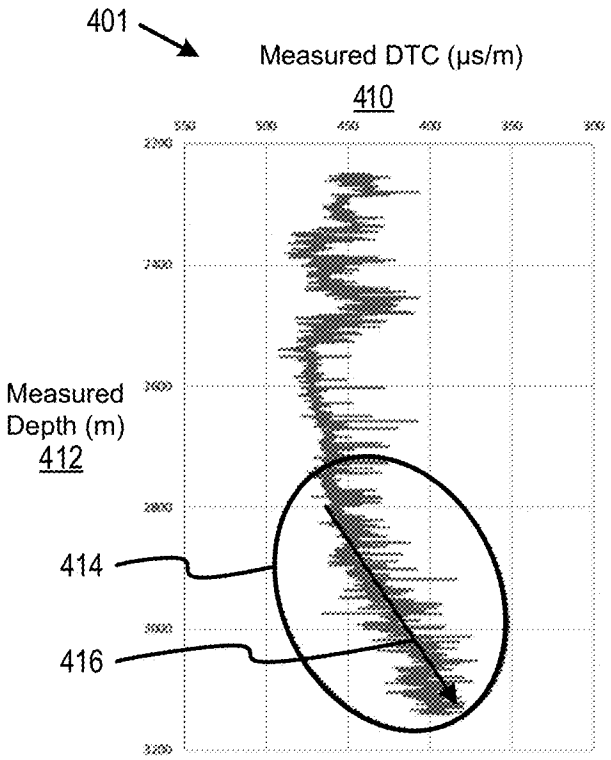
FIGS. 4A-4B are graphs depicting sonic logs and MSE that indicate a change in rock strength, according to some implementations.
Figure 4A:
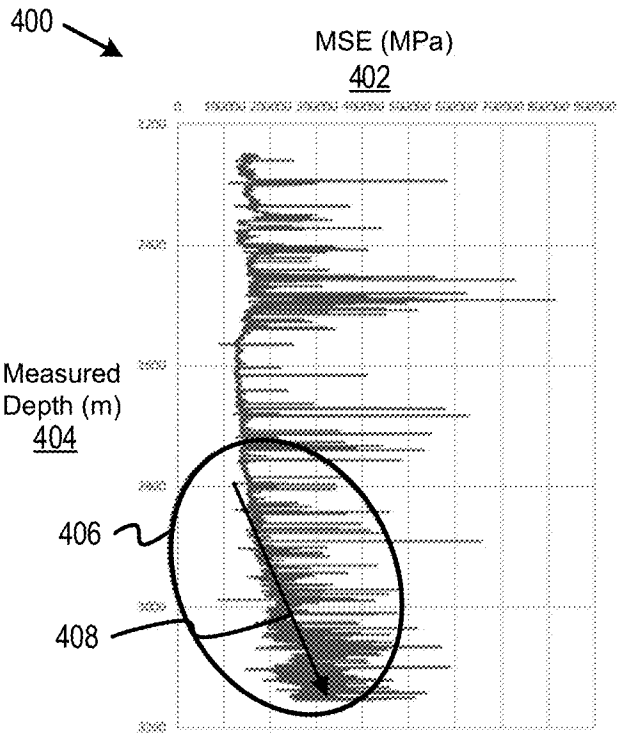

FIGS. 4A-4B are graphs depicting sonic logs and MSE that indicate a change in rock strength, according to some implementations. In FIG. 4A, the graph 400 includes an x-axis 402 and a y-axis 404. The x-axis 402 is the MSE having units in megapascals (MPa). In some implementations, the MSE may be the downhole MSE or the surface MSE. The y-axis 404 is the measured depth having units in meters (m). The area 406 may be a depth interval (approximately 2,800 meters to 3,150 meters) with an ROP that may be less than the ROP for the depths above the area 406 (i.e., there has been a decrease in ROP). As shown, the trend 408 of the MSE over the depth interval in the area 406 is increasing with depth.

In FIG. 4B, the graph 401 includes an x-axis 410 and a y-axis 412. The x-axis 410 is the measured DTC (compressional wave velocity) having units in microseconds per meter (μs/m). The measured DTC may be derived from in-bit sensors on and/or proximate the drill bit. The y-axis 412 is the measured depth having units in meters (m). The area 414 may be similar to the area 406 of FIG. 4A such that the trend 416 may be compared to the trend 408. As shown, the trend 416 of the measured DTC over the depth interval in the area 414 (and similarly area 406) is increasing with depth. Due to the measured DTC units, the x-axis 410 may be configured with measured DTC values in descending order such that the sonic logs may be compared to the MSE of the drill bit.

As shown in FIGS. 4A-4B, both the trend 408 of MSE and the trend 416 of the measured DTC over an approximately similar depth interval are increasing with depth, indicating a decrease in ROP below a depth of 2,800 meters may be caused by an increase in rock strength.

Figure 5B:
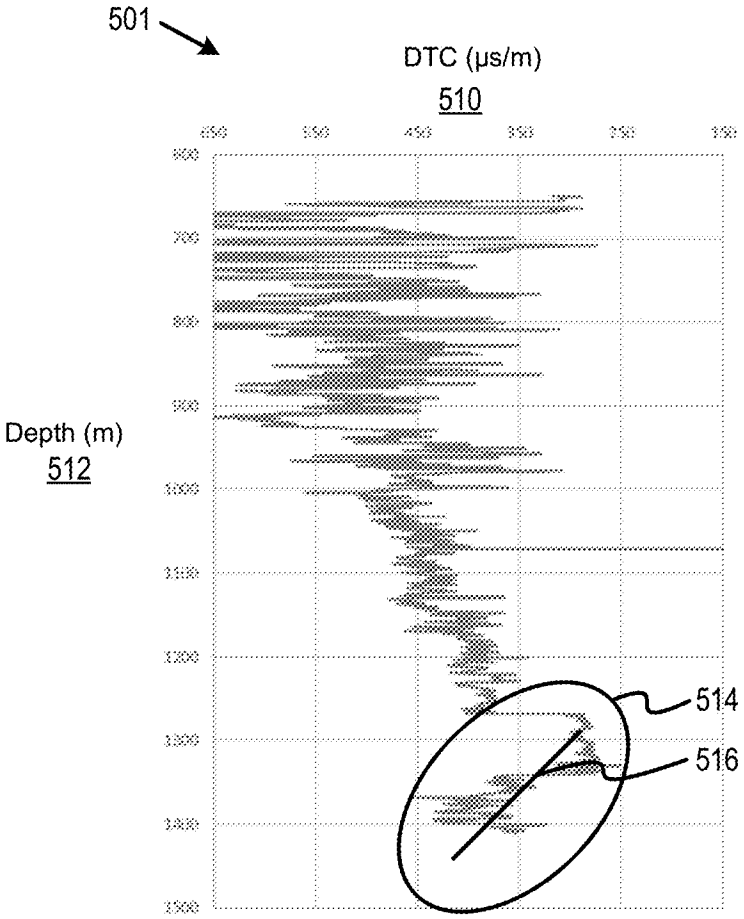
FIGS. 5A-5B are graphs depicting sonic logs and MSE that indicate bit wear, according to some implementations.
Figure 5A:
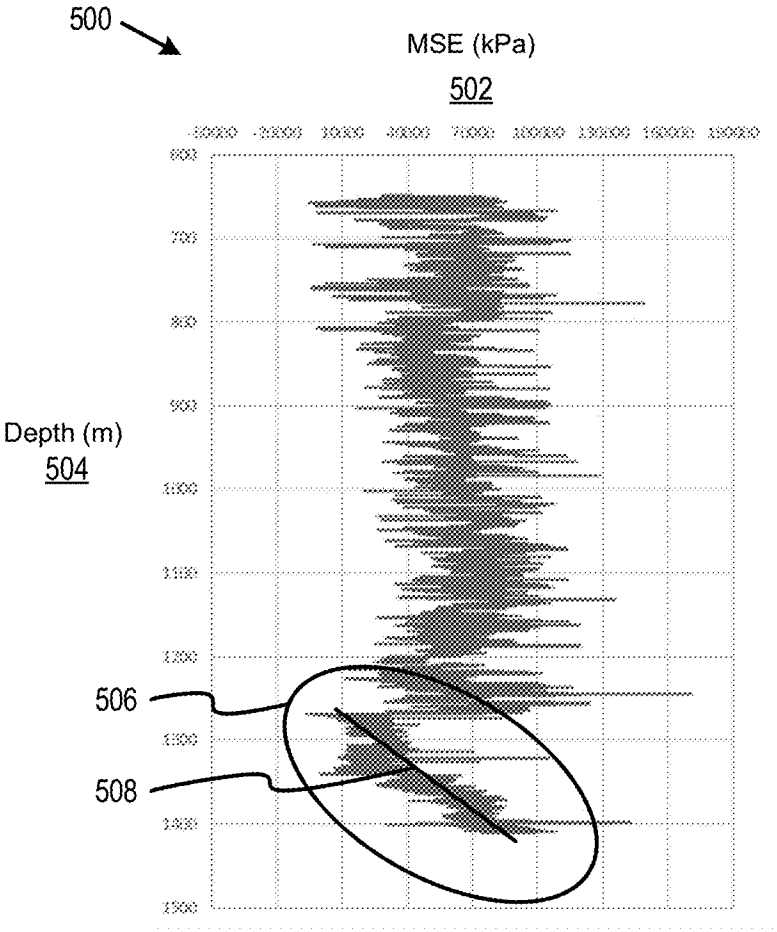

FIGS. 5A-5B are graphs depicting sonic logs and MSE that indicate bit wear, according to some implementations. In FIG. 5A, the graph 500 includes an x-axis 502 and a y-axis 504. The x-axis 502 is the MSE having units in megapascals (MPa). In some implementations, the MSE may be the downhole MSE or the surface MSE. The y-axis 504 is the depth having units in meters (m). The area 506 may be a depth interval (approximately 1,250 meters to 1,420 meters) with an ROP that may be less than the ROP for the depths above the area 506 (i.e., there has been a decrease in ROP). As shown, the trend 508 of the MSE over the depth interval in the area 506 is increasing with depth.

In FIG. 5B, the graph 501 includes an x-axis 510 and a y-axis 512. The x-axis 510 is the DTC (compressional wave velocity, either predicted or measured) having units in microseconds per meter (μs/m). The y-axis 512 is the depth having units in meters (m). The area 514 may be similar to the area 506 of FIG. 5A such that the trend 516 may be compared to the trend 508. As shown, the trend 516 of the DTC over the depth interval in the area 514 (and similarly area 506) is decreasing with depth. Due to the DTC units, the x-axis 510 may be configured with DTC values in descending order such that the sonic logs may be compared to the MSE of the drill bit.

As shown in FIGS. 5A-5B, the trend 508 of MSE and the trend 516 of the DTC over an approximately similar depth interval are different, indicating a decrease in ROP below 1,250 meters may be caused by bit wear. In some implementations, other indicators, such as drill bit stalls, high frequency torsional oscillations (HFTO), etc. above and/or within the depth interval of interest during and/or prior to a decrease in the ROP may be considered when comparing trends. For example, the drill bit may have experienced one or more stalls and/or HFTO may have been observed above the depth 1,250 meters prior to a decrease in ROP. These indicators in addition to the different trends of MSE and sonic logs may indicate bit wear. In some implementations, no indicators besides the respective trends being different, may be observed when ROP decreases, indicating the change in drilling performance may be caused by bit wear.

Returning to block 310, if the respective trends are not different, then operations proceed to block 312. Otherwise, operations proceed to block 314.

At block 312, the processor of the computer 170 may determine the change in the drilling performance is due to increased rock strength. When there is a change in the drilling performance and the respective trends are not different (as depicted in FIGS. 4A-4B), the cause of the change in drilling performance may be increased rock strength. In some implementations, the drill bit may continue to drill the wellbore since there is no indication that the change in drilling performance is due to a worn/damaged drill bit. In some implementations, one or more drilling parameters may be changed to account for the harder rock being drilled. For example, WOB, TOB, RPM, etc. may be increased to increase ROP while drilling through the harder rock. Operations may return to block 302 to continue to monitor the condition of the drill bit.

At block 314, the processor of the computer 170 may determine the change in the drilling performance is due to bit wear. When there is a change in the drilling performance and the respective trends are different (as depicted in FIGS. 5A-5B, 6A-6B, and 7A-7B), the cause of the change in drilling performance may be bit wear.

At block 316, the processor of the computer 170 may determine if the drill bit needs to be replaced. In some implementations, the replacement of the drill bit may depend on whether the replacement would reduce drilling cost. To determine if drilling cost would be reduced by replacing the drill bit, the replacement cost of the drill bit may be compared to the saving if the drill bit is replaced. For example, cost and the savings, represented by C and S, respectively, (using Equations 3-5 below), may be defined as follows:

$$S > C \tag{3}$$

$$C = C_r + C_b = R_{rig} * T + C_b \tag{4}$$

$$S = R_{rig} * L/(ROP_{new} - ROP_{worn}) \tag{5}$$

Where $C_r$ is the cost to replace a drill bit (in dollars), $R_{rig}$ is the rig rate (in dollars per hour), T is the time required for a bit trip to replace the drill bit (in hours), $C_b$ is the cost of a new drill bit (in dollars), L is the remaining wellbore length to be drilled before the next scheduled bit trip (in feet), $ROP_{new}$ is the rate of penetration of the new drill bit (in feet per hour), and $ROP_{worn}$ is the rate of penetration of the worn/damaged drill bit (in feet per hour). In some implementations, $ROP_{new}$ may be estimated by methods such as theoretical models, offset data, artificial neural networks, correlation between ROP and sonic logs (i.e., rock strength), etc. The $ROP_{worn}$ may be quantified with currently measured ROP while drilling the wellbore. The $ROP_{worn}$ may be adjusted according to rock strength variations ahead of the drill bit predicted by sonic logs. For example, the $ROP_{worn}$ (using Equation 6 below), may be defined as follows:

$$ROP_{worn} = cROP_{current} \tag{6}$$

Where c is a constant to account for the ROP change related to rock strength variation and $ROP_{current}$ is the currently measured ROP while drilling the wellbore.

If it is determined that the drill bit needs to be replaced (Equation 3 is satisfied), then operations proceed to block 320. Otherwise, operations proceed to block 318.

At block 318, the processor of the computer 170 may update the drill bit replacement parameters. When it is determined that the drill bit is worn/damaged but the cost to replace the drill bit exceeds the savings when the drill bit is replaced (i.e., Equation 3 is not satisfied), drill bit replacement parameters such as L, T, and $ROP_{worn}$ may be updated due to said drilling parameters dynamically changing during drilling operations. For example, L and T may continue to increase as the wellbore is drilled. Operations may return to block 316 to determine if the drill bit needs to be replaced based on new drill bit replacement parameters. The drill bit replacement parameters may be updated and reevaluated in block 316 at different intervals such as every 30 seconds, 5 minutes, etc. and/or every foot drilled, 30 feet drilled, etc.

At block 320, the processor of the computer 170 may trip the drill string out of the wellbore to replace the drill bit.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 302-308 of flowchart 300 can be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Example Computer

FIG. 6 is a block diagram depicting an example computer, according to some implementations. FIG. 6 depicts a computer 600 for identifying bit wear while drilling wellbore. The computer 600 includes a processor 601 (possibly including multiple processors, multiple cores, multiple nodes, and/or implementing multi-threading, etc.). The computer 600 includes memory 607. The memory 607 may be system memory or any one or more of the above already described possible realizations of machine-readable media. The computer 600 also includes a bus 603 and a network interface 605. The computer 600 can communicate via transmissions to and/or from remote devices via the network interface 605 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 600 also includes a processor 611 and a controller 615 which may perform the operations described herein. For example, the processor 611 may compare the respective trends of sonic logs and MSE. The processor 611 may also determine if a change in drilling performance may be caused by bit wear or an increase in rock strength based on the comparison of the respective trends. The controller 615 may execute one or more actions based on the cause of the change in the drilling performance. The processor 611 and the controller 615 can be in communication. Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and exploitations, it will be understood that these aspects are illustrative and that the scope of the claims is not limited to them. In general, techniques for identifying bit wear as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub combination. Moreover, although features may be described as acting in certain combinations and even initially claimed as such, one or more features from a claimed combination may in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

EXAMPLE IMPLEMENTATIONS

Implementation #1: A method performed while drilling a wellbore in a subsurface formation with a drill bit comprising: obtaining sonic logs of the subsurface formation proximate the drill bit; determining mechanical specific energy based on drilling parameters; comparing respective trends of the sonic logs and the mechanical specific energy of the drill bit to identify a cause for a change in drilling performance of the drill bit; and performing a drilling operation based on the cause for the change in the drilling performance.

Implementation #2: The method of Implementation #1, wherein the cause includes bit wear and an increase in rock strength, and wherein the change in the drilling performance includes a decrease in a rate of penetration of the drill bit.

Implementation #3: The method of Implementation #1 or #2, further comprising: determining the trend in the sonic logs over a depth interval is different than the trend in the mechanical specific energy over the depth interval; determining a decrease in rate of penetration of the drill bit is due to bit wear based on the different trends.

Implementation #4: The method of any one or more of Implementation #1-3, further comprising: determining the trend in the sonic logs over a depth interval and the trend in the mechanical specific energy over the depth interval are increasing; determining a decrease in rate of penetration of the drill bit is due to an increase in rock strength based on the increasing respective trends.

Implementation #5: The method of any one or more of Implementation #1-4, wherein the sonic logs are determined based on real-time sonic logs and predrill sonic logs.

Implementation #6: The method of any one or more of Implementation #1-5, wherein the drilling parameters include weight on bit at the drill bit, torque on bit at the drill bit, rotations per minute at the drill bit, and surface rate of penetration.

Implementation #7: The method of any one or more of Implementation #1-6, wherein the drilling operation includes replacing the drill bit and adjusting drilling parameters.

Implementation #8: The method of any one or more of Implementation #1-7 further comprising; determining the drill bit is damaged based on the respective trends of the sonic logs and the mechanical specific energy at the drill bit; determining a replacement cost of the drill bit and a savings of replacing the drill bit; and performing the drilling operation based on the replacement cost and savings.

Implementation #9: A system comprising: a drill bit configured to drill a wellbore in a subsurface formation; a processor; and a computer-readable medium having instructions stored thereon that are executable by the processor to cause the processor to, obtain sonic logs of the subsurface formation proximate the drill bit; determine mechanical specific energy based on drilling parameters; compare respective trends of the sonic logs and the mechanical specific energy of the drill bit to identify a cause for a change in drilling performance of the drill bit; and perform a drilling operation based on the cause for the change in the drilling performance.

Implementation #10: The system of Implementation #9, wherein the cause includes bit wear and an increase in rock strength, and wherein the change in the drilling performance includes a decrease in a rate of penetration of the drill bit.

Implementation #11: The system of Implementation #9 or #10, further comprising: determining the trend in the sonic logs over a depth interval is different than the trend in the mechanical specific energy over the depth interval; determining a decrease in rate of penetration of the drill bit is due to bit wear based on the different trends.

Implementation #12: The system of any one or more of Implementation #9-11, further comprising: determining the trend in the sonic logs over a depth interval and the trend in the mechanical specific energy over the depth interval are increasing; determining a decrease in rate of penetration of the drill bit is due to an increase in rock strength based on the increasing respective trends.

Implementation #13: The system of any one or more of Implementation #9-12, wherein the sonic logs are determined based on real-time sonic logs and predrill sonic logs.

Implementation #14: The system of any one or more of Implementation #9-13, wherein the drilling parameters include weight on bit at the drill bit, torque on bit at the drill bit, rotations per minute at the drill bit, and surface rate of penetration.

Implementation #15: A non-transitory, computer-readable medium having instructions stored thereon that are executable by a processor to perform operations comprising: obtaining sonic logs of a subsurface formation proximate a drill bit while drilling a wellbore in the subsurface formation; determining mechanical specific energy based on drilling parameters; comparing respective trends of the sonic logs and the mechanical specific energy of the drill bit to identify a cause for a change in drilling performance of the drill bit; and performing a drilling operation based on the cause for the change in the drilling performance.

Implementation #16: The non-transitory, computer-readable medium of Implementation #15, wherein the cause includes bit wear and an increase in rock strength, and wherein the change in the drilling performance includes a decrease in a rate of penetration of the drill bit.

Implementation #17: The non-transitory, computer-readable medium of Implementation #15 or #16, further comprising: determining the trend in the sonic logs over a depth interval is different than the trend in the mechanical specific energy over the depth interval; determined a decrease in rate of penetration of the drill bit is due to bit wear based on the different trends.

Implementation #18: The non-transitory, computer-readable medium of any one or more of Implementation #15-17, further comprising: determining the trend in the sonic logs over a depth interval and the trend in the mechanical specific energy over the depth interval are increasing; determining a decrease in rate of penetration of the drill bit is due to an increase in rock strength based on the increasing respective trends.

Implementation #19: The non-transitory, computer-readable medium of any one or more of Implementation #15-18, wherein the sonic logs are determined based on real-time sonic logs and predrill sonic logs.

Implementation #20: The non-transitory, computer-readable medium of any one or more of Implementation #15-19, wherein the drilling parameters include weight on bit at the drill bit, torque on bit at the drill bit, rotations per minute at the drill bit, and surface rate of penetration.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method performed while drilling a wellbore in a subsurface formation with a drill bit comprising:

obtaining sonic logs of the subsurface formation proximate the drill bit;

determining mechanical specific energy based on drilling parameters;

comparing respective trends over a depth interval of the sonic logs and the mechanical specific energy of the drill bit to determine if a change in drilling performance of the drill bit is caused by bit wear or rock strength; and performing a drilling operation with the drill bit based on the change in the drilling performance.

2. The method of claim 1, wherein the change in the drilling performance includes a decrease in a rate of penetration of the drill bit.

3. The method of claim 1, further comprising:

determining the trend in the sonic logs over the depth interval is different than the trend in the mechanical specific energy over the depth interval; and determining a decrease in rate of penetration of the drill bit is due to the bit wear based on the different trends.

4. The method of claim 1, further comprising:

determining the trend in the sonic logs over the depth interval and the trend in the mechanical specific energy over the depth interval are increasing; and determining a decrease in rate of penetration of the drill bit is due to an increase in the rock strength based on the increasing respective trends.

5. The method of claim 1, wherein the sonic logs are determined based on real-time sonic logs and predrill sonic logs.

6. The method of claim 1, wherein the drilling parameters include weight on bit at the drill bit, torque on bit at the drill bit, rotations per minute at the drill bit, surface rate of penetration, or any combination thereof.

7. The method of claim 1, wherein the drilling operation includes replacing the drill bit, adjusting drilling parameters, or any combination thereof.

8. The method of claim 1 further comprising;

determining the drill bit is damaged based on the respective trends of the sonic logs and the mechanical specific energy at the drill bit;

determining a replacement cost of the drill bit and a savings of replacing the drill bit; and performing the drilling operation based on the replacement cost and savings.

9. A system comprising:

a drill bit configured to drill a wellbore in a subsurface formation;

a processor; and a computer-readable medium having instructions stored thereon that are executable by the processor to cause the processor to, obtain sonic logs of the subsurface formation proximate the drill bit;

determine mechanical specific energy based on drilling parameters;

compare respective trends over a depth interval of the sonic logs and the mechanical specific energy of the drill bit to determine if a change in drilling performance of the drill bit is caused by bit wear or rock strength; and perform a drilling operation with the drill bit based on the change in the drilling performance.

10. The system of claim 9, wherein the change in the drilling performance includes a decrease in a rate of penetration of the drill bit.

11. The system of claim 9, further comprising:

determining the trend in the sonic logs over the depth interval is different than the trend in the mechanical specific energy over the depth interval; and determining a decrease in rate of penetration of the drill bit is due to the bit wear based on the different trends.

12. The system of claim 9, further comprising:

determining the trend in the sonic logs over the depth interval and the trend in the mechanical specific energy over the depth interval are increasing;

determining a decrease in rate of penetration of the drill bit is due to an increase in the rock strength based on the increasing respective trends.

13. The system of claim 9, wherein the sonic logs are determined based on real-time sonic logs and predrill sonic logs.

14. The system of claim 9, wherein the drilling parameters include weight on bit at the drill bit, torque on bit at the drill bit, rotations per minute at the drill bit, surface rate of penetration, or any combination thereof.

15. A non-transitory, computer-readable medium having instructions stored thereon that are executable by a processor to perform operations comprising:

obtaining sonic logs of a subsurface formation proximate a drill bit while drilling a wellbore in the subsurface formation;

determining mechanical specific energy based on drilling parameters;

comparing respective trends over a depth interval of the sonic logs and the mechanical specific energy of the drill bit to determine if a change in drilling performance of the drill bit is caused by bit wear or rock strength; and performing a drilling operation with a drill bit based on the change in the drilling performance.

16. The non-transitory, computer-readable medium of claim 15, wherein the change in the drilling performance includes a decrease in a rate of penetration of the drill bit.

17. The non-transitory, computer-readable medium of claim 15, further comprising:

determining the trend in the sonic logs over the depth interval is different than the trend in the mechanical specific energy over the depth interval; and determined a decrease in rate of penetration of the drill bit is due to the bit wear based on the different trends.

18. The non-transitory, computer-readable medium of claim 15, further comprising:

determining the trend in the sonic logs over the depth interval and the trend in the mechanical specific energy over the depth interval are increasing; and determining a decrease in rate of penetration of the drill bit is due to an increase in the rock strength based on the increasing respective trends.

19. The non-transitory, computer-readable medium of claim 15, wherein the sonic logs are determined based on real-time sonic logs and predrill sonic logs.

20. The non-transitory, computer-readable medium of claim 15, wherein the drilling parameters include weight on bit at the drill bit, torque on bit at the drill bit, rotations per minute at the drill bit, surface rate of penetration, or any combination thereof.

* * * * *